US006701743B1

(12) United States Patent
Durst et al.

(10) Patent No.: US 6,701,743 B1
(45) Date of Patent: Mar. 9, 2004

(54) NON-SPILLING CRYOGENIC TRANSFER VIAL FOR CRYSTAL SAMPLE MOUNTING

(75) Inventors: Roger D. Durst, Middleton, WI (US); Bob Baoping He, Madison, WI (US); Stephen I. Foundling, Verona, WI (US); Max Li, Platteville, WI (US)

(73) Assignee: Bruker AXS, Inc., Madison, WI (US)

( * ) Notice: Subject to any disclaimer, the term of this patent is extended or adjusted under 35 U.S.C. 154(b) by 55 days.

(21) Appl. No.: 10/005,504

(22) Filed: Dec. 3, 2001

(51) Int. Cl.[7] ..... F25B 21/00
(52) U.S. Cl. ..... 62/457.9; 62/371
(58) Field of Search ..... 62/457.9, 371, 62/46.3, 48.3, 60

(56) References Cited

U.S. PATENT DOCUMENTS 5,321,955 A * 6/1994 Leonard ..... 62/51.1
5,419,143 A * 5/1995 Leonard et al. ..... 62/51.1
5,632,151 A * 5/1997 Baker et al. ..... 62/64
6,119,465 A * 9/2000 Mullens et al. ..... 62/60

FOREIGN PATENT DOCUMENTS

EP 000172101 A1 * 2/1986 ..... 62/46.3

* cited by examiner

*Primary Examiner*—Melvin Jones
(74) *Attorney, Agent, or Firm*—Kudirka & Jobse, LLP

(57) ABSTRACT

A cryogenic transfer vial for storing and loading a crystal sample on a goniometer includes a cryogen retainer that inhibits spillage of the cryogen when the vial is inverted during sample loading and retrieval. The retainer may be an adsorptive material located in a region of the vial near a sample location, or may be a baffle arrangement within the vial for containing the cryogen.

22 Claims, 2 Drawing Sheets

NON-SPILLING CRYOGENIC TRANSFER VIAL FOR CRYSTAL SAMPLE MOUNTING

FIELD OF THE INVENTION

This invention relates generally to the field of x-ray diffraction and, more specifically, to the mounting of cryogenically cooled crystallography samples on an x-ray diffraction goniometer.

BACKGROUND OF THE INVENTION

In recent years, it has become common to use x-ray diffraction for the structural determination of biological macromolecules (proteins). To protect the protein crystals from radiation damage, it is desirable to cool them to cryogenic temperatures. This is typically accomplished by storing them in a liquid nitrogen dewar and then transferring them onto a goniometer equipped with a device which cools the sample during the measurements by blowing cold nitrogen (or helium) gas onto the sample. However, of course, the samples must be maintained at cryogenic temperatures while they are transferred from the storage dewar onto the goniometer. To transfer the samples to the goniometer, cryogenic transfer vials have been used. An example of a typical prior art vial is shown in FIG. 1.

The prior art sample vial 10 consists of an outer container 12, typically made of a plastic material, and a magnetic base 14. Attached to the base 14 is a sample holder that extends into the vial 10, and includes a fastener 18 at the end that holds a crystal sample 20 in place. In the preferred embodiment, the fastener is a surgical nylon loop (10–20 $\mu$m), but also may take other forms. As shown in the figure, the base/sample holder combination has a shape and size that allows it to form a seal with the container 12, with the sample holder projecting into the container interior. In order to maintain the sample at cryogenic temperatures, the container is filled with a cryogen 22, typically liquid nitrogen. The vial is vented to allow the escape of boiled-off cryogen. This cryogen maintains the crystal at a sufficiently low temperature, but causes difficulties in practice. The standard goniometer receives the magnetic base 14 of the vial, but is located such that the sample holder 16 projects outward at a horizontal angle. Thus, as the container 12 is removed from the base, much or all of the cryogen spills out and is lost. Once the cryogen is lost, the sample crystal will rapidly warm up towards room temperature and can be damaged. It is possible also to remove the base from the upright container with a hand tool such as "cryotongs." In this case, there is no cryogen used. Rather the cryotongs are cooled to liquid nitrogen temperatures and the thermal mass of the cryotong head keeps the sample cold during the transfer process.

However, to remove the base in this manner and successfully transfer it to the goniometer requires an inordinate degree of quickness and dexterity, and makes the process more difficult and subject to failure. There are also a limited number of "inverted sample" goniometers in service that can be used to position the base so that the sample holder faces downward. This allows the container 12 to be removed without spilling the cryogen. However, such goniometers have drawbacks including higher cost, less geometric access to the sample and less flexibility in orienting the sample, and thus the use of this solution is limited in practice.

SUMMARY OF THE INVENTION

In accordance with the present invention a cryogenic transfer vial is provided for use with a crystal sample material and allows transfer of a sample holder to a goniometer without spilling of a cryogen in the vial, such as liquid nitrogen. The vial includes an outer container surface within which the sample material is enclosed. A container lid that seals to the outer surface also serves as a base, typically magnetic, for a sample support to which the sample material is attached. With the lid in place on the vial, the sample support extends into the vial, such that the sample material is suspended at a sample location within. Within the container outer surface is a cryogen retainer that surrounds the sample location and that retains the cryogen in that region, particularly against the force of gravity. The retainer prevents any significant spillage of the cryogen if the transfer vial is inverted and opened, such as during placement of the sample support lid in a goniometer, and removal of the outer container.

In one embodiment of the invention, the cryogen retainer is an adsorptive material located within the outer container surface. The adsorptive quality of the material easily holds the cryogen in place, even if the vial is inverted. Such a material may be, for example, a carbon foam that fills a portion of the vial, but not the sample location. The foam may be below the sample in the vial, and may also partially surround it. In another embodiment, the retainer may be a baffle that, in conjunction with the outer surface, forms a region surrounding the sample location within which the cryogen is contained. The surrounding region is vented, and may have an opening at an end away from the container lid. This would allow for filling of the vial with cryogen, while still ensuring that the majority of the cryogen is retained when the vial is open and inverted.

BRIEF DESCRIPTION OF THE DRAWINGS

The above and further advantages of the invention may be better understood by referring to the following description in conjunction with the accompanying drawings in which.

DETAILED DESCRIPTION

Figure 2:
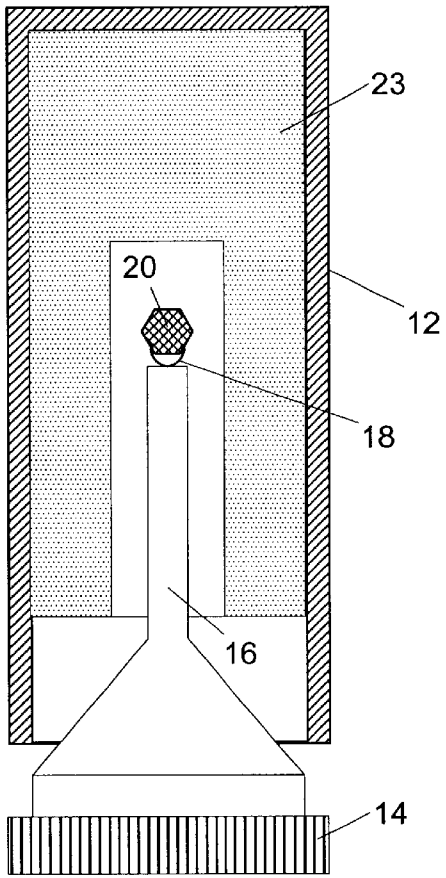
FIG. 2 is a schematic view of a cryogenic vial according to the present invention that uses as a cryogen retainer an adsorptive material that partially surrounds the sample.

Shown in FIG. 2 is a first embodiment of a vial according to the present invention. Some of the components of the FIG. 2 vial can be identical to those of the prior art vial shown in FIG. 2. For example, outer container portion 12 and magnetic base 14 are the same, as are the sample holder 16 and fastener 18. Like the FIG. 1 vial, that of FIG. 2 is configured so that the base 14 forms a seal with the container portion 12, and the sample holder projects into the interior of the vial. Thus, when sealed, the sample holder maintains a sample crystal 20 well within the vial.

In addition to these components, the vial also has an adsorptive material 23, such as a foam. An appropriate foam material may be carbon-based foam. Such a foam functions as a medium for holding the liquid nitrogen, and can hold a temperature of −150° C. for about fifteen seconds. However, the foam medium 23 prevents the cryogen from spilling out of the container 12, particularly against the force of gravity when the vial is inverted. Therefore, the base 14 and sample holder can be applied to a goniometer having a horizontal sample support positioning, or even one that directs the sample support upward. When the magnetic base 14 is applied, and the container 12 is removed, there is no spillage of the cryogen. Those skilled in the art will recognize that, although the FIG. 2 embodiment is described in terms of using a foam, any material capable of absorbing and retaining the cryogen would be appropriate for use in place of the foam.

Figure 3:
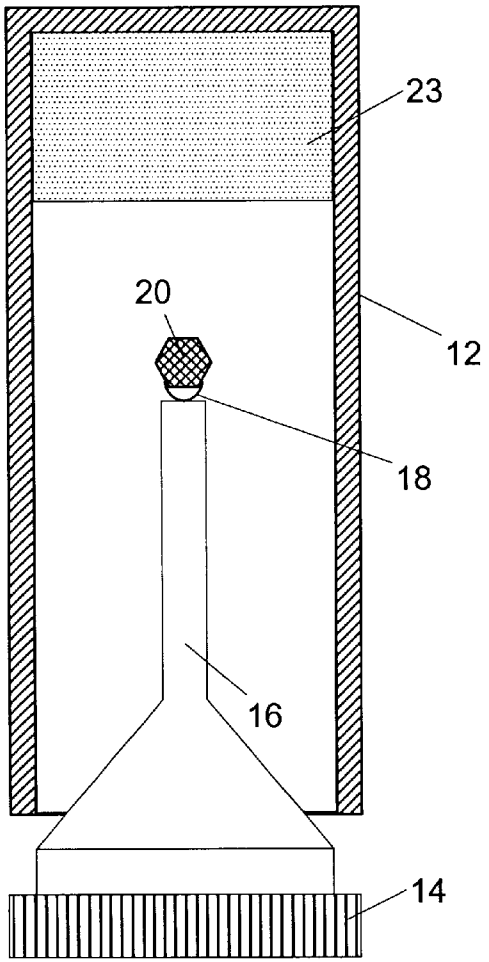
FIG. 3 is a schematic view of a cryogenic vial according to the present invention that uses an adsorptive material located in the vial below the sample.

Shown in FIG. 3 is another variation of the embodiment using an adsorptive foam as the cryogen retainer. In this figure, all of the reference numerals are the same as those shown in FIG. 2. However, the foam 23 does not encircle the sample location. Rather, the foam 23 resides beneath the sample in the vial (if the opening of the vial is considered the "top" ). While this embodiment may not provide the same level of thermal transfer as that of FIG. 2, it is sufficient for keeping the sample at cryogenic temperatures, and minimizes the chance of accidentally contacting the foam with the sample and possibly damaging it.

Figure 4:
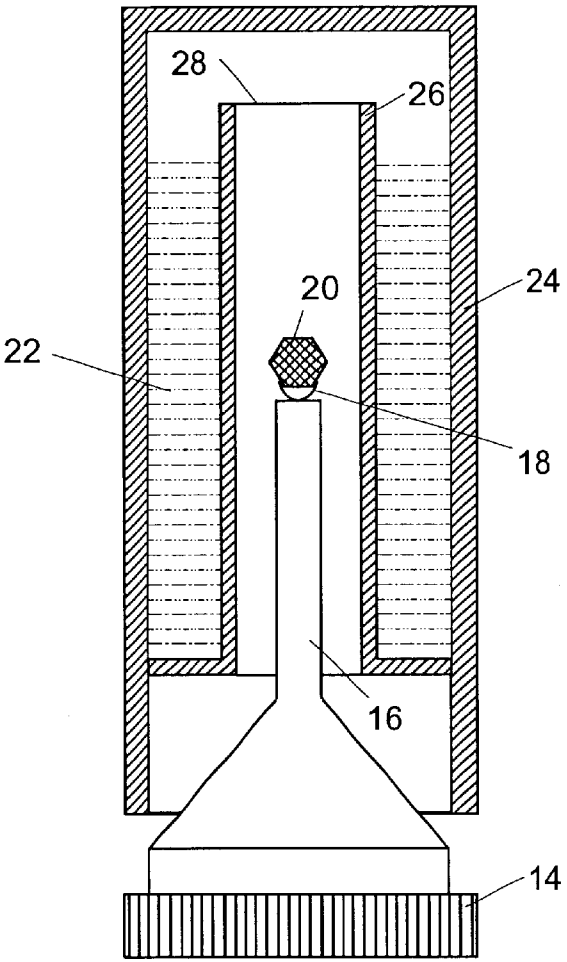
FIG. 4 is a schematic view of a cryogenic vial according to the present invention that uses an internal baffle as a cryogen retainer.

Another alternative embodiment of the invention is shown in FIG. 4. As in the embodiment of FIGS. 2 and 3, the vial shown in FIG. 4 makes use of magnetic base 14 connected to sample support 16. Similarly, the crystal sample 20 is attached to the sample support with the same type of fastener 18. However, in the FIG. 4 embodiment, the container 24 includes an internal baffle 26. The baffle 26 is preferably cylindrical in shape, and rotationally equidistant from the outer surface of the cylindrical container 24, although those skilled in the art will recognize that many different baffle shapes may work just as effectively, as would different container shapes. The baffle 26 and the outer wall of the container 24 form a reservoir in which a cryogen 22, such as liquid nitrogen, may be trapped. This reservoir retains the cryogen when the container 24 is inverted, preventing the spillage that is common in prior art transfer vials. As such, the magnetic base may be applied to a goniometer having a horizontal or even upright sample holder direction, and the outer container removed from the base without the cryogen being spilled.

Figure 1:
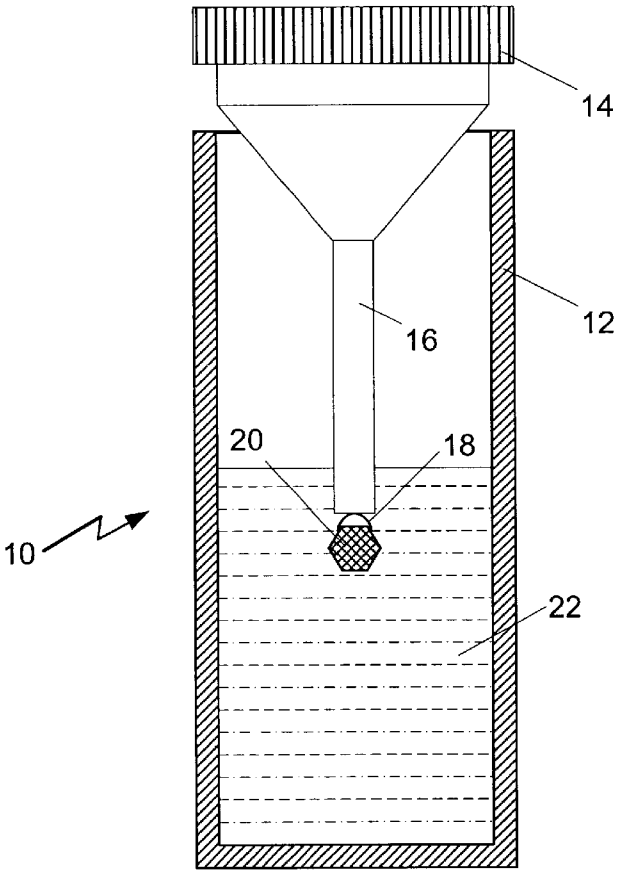
FIGURE 1 (PRIOR ART)
FIG. 1 is a schematic view of a prior art transfer vial used for cryogenic sample transport.

As in the container of FIG. 1, the container 24 may be constructed of a plastic material, as may be the baffle 26. The baffle 28 is vented to allow evaporated cryogen to escape. In one version of this embodiment, the end 28 of the baffle is open, so that the cryogen may be added to the vial prior to use, and accumulate in the space between the baffle and the outer container wall. Although this might result in a small amount of cryogen being spilled during application of the base 14 to the goniometer, due to the presence of some cryogen in the interior of the baffle portion, the majority will be retained in the space between the baffle and the outer container wall.

While the invention has been shown and described with regard to preferred embodiments thereof, it will be understood by those skilled in the art that various changes in form and detail may be made therein without departing from the spirit and scope of the invention as defined by the appended claims.

What is claimed is:

1. A cyrogenic transfer vial in which a crystal sample material may be housed for transfer to a goniometer, the vial comprising:

an outer container surface within which the sample material is enclosed;

a container lid that seals to the outer surface and that has a sample support to which the sample material is secured such that the sample material is suspended at a sample location within the vial; and a cryogen retainer that retains a cryogen within the vial against the force of gravity.

2. A vial according to claim 1 wherein the cryogen retainer comprises an adsorptive material.

3. A vial according to claim 2 wherein the adsorptive material comprises a foam.

4. A vial according to claim 3 wherein the foam comprises carbon.

5. A vial according to claim 2 wherein the adsorptive material encircles the sample location when the lid is sealed to the outer surface.

6. A vial according to claim 2 wherein the adsorptive material resides to the side of the sample location away from an opening of the vial.

7. A transfer vial according to claim 1 wherein the cryogen retainer comprises a baffle within the vial.

8. A vial according to claim 7 wherein the baffle defines a cryogen-containing region between the sample location and the outer surface that is open to the sample region at an end of the vial away from where the container lid seals to the outer surface.

9. A vial according to claim 1 wherein the container lid comprises a magnetic portion that may be magnetically connected to a goniometer.

10. vial according to claim 1 wherein the cryogen is liquid nitrogen.

11. A cyrogenic vial in which a crystal sample material may be housed for transfer to a goniometer, the vial comprising:

an outer container surface within which the sample material is enclosed;

a container lid that seals to the outer surface and that has a sample support to which the sample material is secured such that the sample material is suspended at a sample location within the vial, the container lid comprising a magnetic portion that may be magnetically connected to a goniometer; and an adsorptive material capable of retaining a cryogen within the vial against the force of gravity.

12. A cyrogenic vial in which a crystal sample material may be housed for transfer to a goniometer, the vial comprising:

an outer container surface within which the sample material is enclosed;

a container lid that seals to the outer surface and that has a sample support to which the sample material is secured such that the sample material is suspended at a sample location within the vial, the container lid comprising a magnetic portion that may be magnetically connected to a goniometer; and a baffle that forms a containing region between the sample location and the outer surface in which a cryogen may be contained.

13. A method of transferring a crystal sample material to a goniometer, the method comprising:

providing a cyrogenic vial in which a crystal sample material is housed during transfer to the goniometer, the vial having an outer container surface within which the sample material may be enclosed and a cryogen retainer that retains a cryogen within the vial against the force of gravity;

adding cryogen to the vial such that it is retained by the retainer;

mounting the crystal sample material on a sample support that is connected to a base portion;

inserting the sample support into the vial such that the crystal sample is suspended at the sample location, and such that the lid provides a seal with the outer surface of the vial; and transferring the base portion to the goniometer, and removing the outer container such that the sample remains fixed to the goniometer.

14. A method according to claim 13 wherein the cryogen retainer comprises an adsorptive material.

15. A method according to claim 14 wherein the adsorptive material comprises a foam.

16. A method according to claim 15 wherein the foam comprises carbon.

17. A vial according to claim 13 wherein the adsorptive material encircles the sample location when the lid is sealed to the outer surface.

18. A vial according to claim 2 wherein the adsorptive material resides to the side of the sample location away from an opening of the vial.

19. A method according to claim 13 wherein the cryogen retainer comprises a baffle within the vial.

20. A method according to claim 19 wherein the baffle defines a cryogen-containing region between the sample location and the outer surface that is open to the sample region at an end of the vial away from where the container lid seals to the outer surface.

21. A method according to claim 13 wherein the container lid comprises a magnetic portion that may be magnetically connected to a goniometer.

22. A method according to claim 13 wherein the cryogen is liquid nitrogen.

* * * * *